United States Patent [19]

Harlow et al.

[11] 4,072,029

[45] Feb. 7, 1978

[54] RACKING MECHANISMS

[75] Inventors: David Arthur Harlow, Coalville; Gillies Wood, Evington, both of England

[73] Assignee: The Bentley Engineering Company Limited, Leicester, England

[21] Appl. No.: 681,904

[22] Filed: Apr. 30, 1976

[30] Foreign Application Priority Data

May 14, 1975 United Kingdom ..... 20257/75

[51] Int. Cl.[2] ..... D04B 15/66

[52] U.S. Cl. ..... 66/154 R

[58] Field of Search ..... 66/154 R, 155, 14

[56] References Cited

U.S. PATENT DOCUMENTS

| | | | |
|---|---|---|---|
| 1,203,087 | 10/1916 | Wildman et al. | 66/155 |
| 2,436,468 | 2/1948 | Bristow | 66/155 |
| 2,841,970 | 7/1958 | Saunders | 66/155 |
| 3,169,384 | 2/1965 | Goyle | 66/154 R X |
| 3,218,830 | 11/1965 | Deans et al. | 66/155 |

FOREIGN PATENT DOCUMENTS

| | | | |
|---|---|---|---|
| 1,162,024 | 1/1964 | Germany | 66/154 R |
| 2,303,253 | 8/1973 | Germany | 66/154 R |
| 685,690 | 1/1953 | United Kingdom | 66/155 |

*Primary Examiner*—Mervin Stein
*Assistant Examiner*—Andrew M. Falik
*Attorney, Agent, or Firm*—Robert E. Burns; Emmanuel J. Lobato; Bruce L. Adams

[57] ABSTRACT

A racking mechanism for a circular knitting machine includes at least four pawls drivable in succession in synchronization with needle cylinder movement on the knitting machine, and an evenly cut rack wheel which may be attached to a pattern drum of the knitting machine with elements to cause the pawls to selectively engage the rackwheel and to rack the pattern drum as and when required during a racking sequence.

In a particular embodiment, the racking mechanism includes a device to enable all pawls to be bluffed outside a racking sequence which device can be triggered to unbluff from a timing chain stud and can be operated to bluff at the end of a sequence by a cam piece on the rackwheel.

6 Claims, 4 Drawing Figures

RACKING MECHANISMS

The invention relates to racking mechanisms for use especially in controlling patterning operations on a circular knitting machine, such as a superimposed double cylinder machine for making socks. In the Specification reference is made to revolutions of the cylinder. The reference is in each case to the relative rotating of the cylinder and the knitting cams and it is intended to cover the use of the invention on knitting machines in which the cylinder revolves as well as on knitting machines in which the knitting cams revolve.

Racking mechanisms are used for example on sock knitting machines to rack a pattern drum through an accurately controlled angle at a particular stage of knitting of the sock. The pattern drum then resets certain knitting instruments which it controls such as bolt cams and the reciprocatory/rotary clutch of the cylinder drive. The racking movements of the pattern drum are controlled through two separate pawl drives. A timing chain is advanced at regular intervals during the knitting of a sock by a first pawl drive having studs. The first pawl drive provides a timing chain advance in step with the whole numbers of cylinder revolutions which have taken place during knitting of the sock by rotation or whole numbers of swing which have taken place by reciprocation of the cylinders. In many sock machines the timing chain advances by one link in the period corresponding to two cylinder revolutions or a pair of successive reciprocatory swings. When a stud on the timing chain has been advanced to the appropriate operative position it activates the second pawl drive which engages a rackwheel rotatable conjointly with the pattern drum. The second pawl drive serves to provide a pattern drum advance in step with the knitting of one or more fractions of cylinder revolutions (each fraction being generally one half or one quarter) when it has been activated by a timing chain stud. In this way bolt cams may be inserted for example after a series of high slider butts has moved past the bolt cams and the clutch can be actuated at the appropriate, predetermined stage of reciprocation.

The racking mechanism of the invention is primarily concerned with control of the second pawl drive so as to provide an effective stroke at a particular stage of the knitting of a course. The racking mechanism of the invention may be set and checked easily. The racking mechanism of the invention is not directly applicable to the first pawl drive. In preferred embodiments of the invention, the racking mechanism of the invention is concerned a with the selection of the cylinder revolution, at which the second pawl drive is to be activated, by the use of part length studs on the timing chain; b with the termination of the activation of the second pawl drive without reference to the timing chain using cam pieces on the rackwheel; and c with adapting the second pawl drive to enable the clutch to be actuated only at a predetermined stage of reciprocation by the use of pawls operating at different frequencies than others.

The preceding comments on the use of the invention on sock knitting machines are purely exemplary and made to enable the reader to inter-relate the features referred to in the more general description which follows. The inherent flexibility of the racking mechanism of the invention enables it to be adapted for applications other than to control the pattern drum of sock machines.

The West-German Auslegeschrift No. 1162024 published Jan. 30, 1964 describes a racking mechanism using four pawls acting in succession to engage a rackwheel assembly. Individual rackwheels are manufactured and cut to suit a particular patterning requirement. The pawls are bluffed, when no racking is needed, by a lever operated from a full length chain stud which controls the start and end of an activation period for racking lasting two cylinder revolutions during which altogether four individual pawl strokes are made each capable of advancing the rackwheel during ½ a cylinder revolution.

This racking mechanism requires large stocks of individually cut rackwheels to be kept for manufacturing and servicing. This mechanism also incorporates racks which do not influence any knitting instruments and which have no other purpose than to avoid wanted racks being taken prematurely. This causes a waste of pattern drum space. The mechanism would be difficult to adapt to provide four strokes per revolution.

The German Auslegeschrift No. 1560936 published Aug. 22, 1974 corresponding to British Pat. No. 1,094,924 published Dec. 13, 1967 and to U.S. Pat. No. 3,118,830 describes a racking mechanism which employs indirect bluffing of a pair of pawls acting in succession to engage an evenly cut rackwheel. The indirect bluffing operation and sequence of pawl/rack wheel engagement are controlled from an auxiliary drum. The pawls are kept immobile when no racking is needed by disengaging the pawls from the constantly rotating cams which control pawl movement. The pawls are mobilized for the duration of an activation period by a full length stud, controlling the start and end of an activation period for racking lasting two cylinder revolutions during which altogether eight individual pawl strokes are made, each capable of advancing the rackwheel during ¼ of a cylinder revolution.

Premature racks are avoided by part of the indirect bluffing mechanism which prevents unwanted racks being taken during the remainder of an activation period. If two activation periods follow one another immediately a pair of full length studs is required immediately after one another on the timing chain.

The racking mechanism of the British Pat. No. 1,094,924 overcomes many of the disadvantages of the Auslegeschrift No. 1162024, but the overlapping movement of the two pawls must be very accurately controlled to provide a continuous movement and to ensure that the indirect bluffing selection is not too early, prior to the pawl/rackwheel engagement, nor too late after the pawl has passed the appropriate rackwheel tooth. This leads to the need for very accurate manufacturing tolerances and difficulties as the mechanism becomes subject to wear. The indirect selection is difficult to understand as the actual selection does not depend solely on a bluffing element next to the rackwheel tooth but also the elements spaced peripherally from that element. This increases the time taken in manufacture for setting up the knitting machines. The immobilisation of the pawls may lead to excessive wear as a result of the periodic knocks by the tips of the still rotating cams controlling the pawl movement. The pawls cannot easily be kept deactivated in the manner of the Auslegeschrift No. 1560936 since this would introduce a second indirect bluffing mechanism. If two activation periods are to follow one another immediately no timing chain saving mechanism can be used which provides a periodic advance of the timing chain.

It is the purpose of the invention to provide an improved racking mechanism which can be used for a large variety of knitting machines without requiring large stores of rackwheels which reduces the number of unwanted racks, which can be manufactured to the usual tolerances, avoids excessive wear and reduces maintenance requirements, which can be set easily and which enables two successive activation periods to be provided with a timing chain saving mechanism.

The purposes of the invention are achieved at least in part by using a direct bluffing mechanism only mounted on the rackwheel teeth to control rack selection for a racking sequence and by using an indirect bluffing mechanism for determining the start and end of the sequence. The indirect bluffing mechanism is further adapted to serve a dual purpose, initiating a racking sequence from a timing chain stud and terminating it from a cam piece on the rackwheel, thus avoiding the use of further direct, indirect or immobilising bluffing mechanisms and making the length of the sequence after its start independent of the presence of a timing chain stud. In addition the mechanical safety mechanism to prevent wrong clutch operation for rotary or reciprocal operation, has been incorporated in the racking mechanism itself and not in the timing chain or its studs.

The invention has been conveniently executed by combining the direct bluffing elements on the rackwheel with a racking sequence starting and ending mechanism, in which the end of sequence is effected whilst priming the mechanism for a subsequent, quick, triggered release to start it so that both the direct bluffing elements and indirect bluffing element on the rackwheel can be accommodated in the one short tooth pitch required to provide a racking movement for every ¼ cylinder revolution on a reasonable sized pattern drum.

The invention firstly provides a racking mechanism for a circular knitting machine including at least four pawls for advancing in succession, an evenly cut rackwheel, and elements for mounting on the rackwheel for conjoint rotation therewith for causing the pawls to selectively engage the rackwheel during a racking sequence. The rackwheel may be mounted coaxially on a pattern drum of a sock knitting machine and move conjointly with the pattern drum. The elements may be members for inserting into mounting grooves cut at even spaces in the rackwheel, the elements serving as rackwheel teeth and forming a pawl engaging surface in the path of a certain pawl but not others. The elements may also be inserted into mounting holes, which may be screw threaded cut at even spaces in the rackwheel. Preferably the rackwheel has evenly cut teeth and the elements are adapted to raise all except a certain pawl and the elements are masking or shielding members for mounting at evenly cut rackwheel teeth to prevent a tooth from engaging all except one pawl. Suitably then the elements are adapted to deflect the pawls and the elements have an inclined portion for deflecting the pawls and a radially extending portion extending, next to the tooth surface to be masked, into a groove for mounting the element located between adjacent teeth. The elements may thus be retained on and between the teeth and act directly on the pawls. The pressure of the pawls tends to locate the elements firmly against the tooth surface and in the groove. Preferably the elements engage the tip of the pawls, thus ensuring in a most direct way that the bluffing coincides with the appropriate part for selection of the forward movement of the pawls. It is particularly desirable that all of a tooth is masked except for a portion which is to engage a particular pawl. In this way it is easy to observe which pawl will engage a particular tooth. Suitably a pair of the pawls is adapted to advance alternately at half the frequency of the remaining pawls. The pawls are all advanced by cams rotatable in step with a rotary/reciprocatable drive on a sock knitting machine. The racking mechanism of the invention can thus be used to time the racking movements of the rackwheel with respect to a particular stage of a cylinder revolution.

The term "racking sequence" is used herein to indicate any racking sequence including those consisting of a single racking movement between the start and end of a sequence and includes any idle pawl strokes. Advantageously means are provided in addition to the elements for bluffing all of the pawls simultaneously. Conveniently the bluffing means includes a member for lifting all the pawls away from the rackwheel. Preferably the bluffing means is operable to end a racking sequence by indirect bluffing elements associated with the rackwheel. Conveniently the bluffing means is operable to unbluff all the pawls at the start of a racking sequence by a timing chain stud. Thus the racking movements of the rackwheel can be timed on a sock knitting machine to take place sometime during a particular cylinder revolution, the exact stage of the revolution at which racking occurs, being timed by the racking mechanism of the invention. The studs may be a fraction of the length of a link of the timing chain so that the racking sequence can be started at different moments during an activation period corresponding to the period required for the advance of the chain by the length of a single link. Where pawls are driven by cams having more than one lobe, the part-length studs can be used to cause a predetermined lobe of the cam to move the pawl through an effective pawl stroke and so to select whether a particular pawl acts at a first or a subsequent cylinder revolution on a sock machine.

For example eight pawls may be provided to advance once each during eight successive quarters of two cylinder revolutions. Full length studs may then be used. Four pawls may alternatively be used to advance successively during four successive quarters of the first and again during the second revolution. Selection between the two revolutions can be made using half length studs. One pawl of the four pawls may be replaced by a pair of pawls each advancing once only during a two cylinder revolution period, one advancing in the first revolution and the other advancing in the second revolution.

In the alternative construction in which the elements form rackwheel teeth, the rackwheel teeth may be of different kinds by extending to different heights and the pawls may be reciprocated at different levels (for example during successive revolutions) to engage certain teeth but not others. Preferably the level of reciprocation is controlled by means of studs with different heights on the timing chain.

Advantageously the bluffing means is adapted to cooperate with a lever having a follower for engaging timing chain studs and having a nose for urging the bluffing means into a position where no bluffing of the pawls occurs. Suitably the bluffing means is biased into a position where no bluffing of the pawls occurs and the nose is adapted to engage the bluffing means only when it is in a position where bluffing of the pawls does occur but not after the bluffing means has moved to the position where no bluffing of the pawls occurs. The nose thus effectively "triggers" the start of a racking sequence. Preferably a means is provided movable conjointly with the rackwheel for moving the bluffing means against a bias to bluff the pawls at the end of a sequence. Advantageously the bluffing means includes a radially movable projection and the means movable conjointly with the rackwheel is a removable cam piece on the rackwheel to engage the projection and bluff the pawls. The raising may terminate the racking sequence whilst spring loading the mechanism for a triggered release and bluffs the racking mechanism until it is, once more, triggered.

Suitably the bluffing means comprises a first mounting member pivotably mounted, a spring biasing the mounting member radially inward with respect to the rackwheel, a second mounting member pivotably mounted on the first, the bluffing member for engaging the pawls being mounted on the second mounting member, and an abutment plate for locating the bluffing member, the projection being on the second mounting member. The bluffing member which may be a rod is thus movable slightly in a peripheral direction as the second member pivots with respect to the first and movable considerably in a radial direction as the first member pivots. The abutment plate is shaped to restrict movement of the bluffing member as appropriate. Thus the projection on the second member can be knocked off the cam piece as the timing chain controlled lever is pivotted.

Using this construction for the bluffing means, it can be conveniently controlled as required by the timing chain and the cam pieces on the rack wheel. The nose of the timing chain controlled lever should then be adapted to urge the rod away from the abutment member, off the cam piece so as to enable the rod to move to a position where the pawls are active.

The invention is more particularly described with reference to the drawings in which.

CONSTRUCTION, GENERAL

Figure 1:
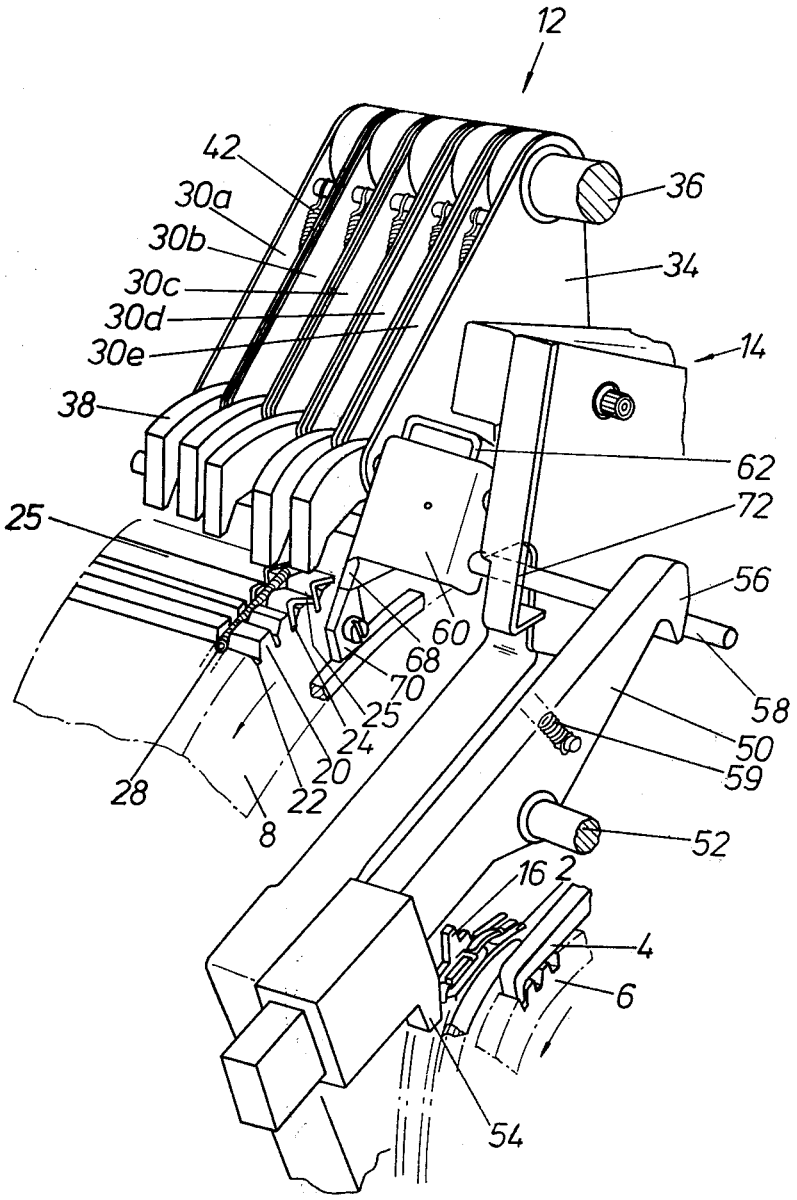
FIG. 1 is a perspective view of a racking mechanism according to the invention from the front.
Figure 2:
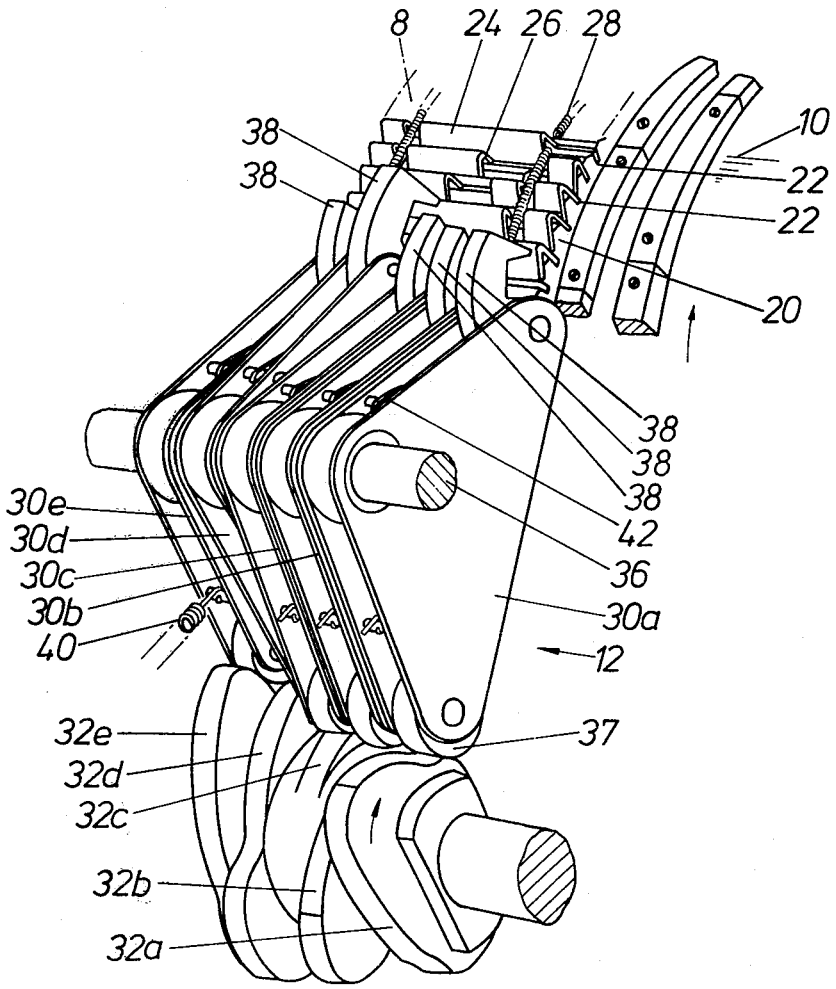
FIG. 2 is a perspective view of the racking mechanism of FIG. 1 from behind.

With reference to FIG. 1, a racking mechanism is mounted on a circular knitting machine and includes a timing chain 2, a pawl 4 and rack wheel 6 for moving the timing chain; a rack wheel 8 rotatable conjointly with a pattern drum 10 (a small portion of which is shown in FIG. 2) and pawl means 12 for moving the pattern drum; and a racking sequence trigger and arresting mechanism 14 between the timing chain 2 and the pawl means 12 for bluffing and unbluffing the pawl means 12 in its entirety. The pawl 4 and pawl means 12 reciprocate in synchronization with the rotation of the cylinders of the knitting machine at all times. The timing chain 2 has studs 16 which at appropriate times activate the pawl means 12 through the mechanism 14 to cause the pattern drum to rotate in a predetermined fashion at predetermined times during the production of knitted fabric on the knitting machine.

THE RACKWHEEL 8

The rackwheel 8 has teeth 20 cut at the same pitch. Recesses 22 are cut between the teeth for receiving bluffing elements 24 which control the selection of racks between the start and end of a racking sequence. Each bluffing element 24 has a cut-away 26 to enable a particular pawl of the pawl means 12 to engage the rackwheel 8. The bluffing elements 24 can be secured by band springs 28 or steel bands. The elements 24 have a radially outwardly inclined portion 25 extending from the edge 21 of a preceding tooth for deflecting the pawls 38 and a radial portion 27 bearing against the face of the tooth and received in the recesses 24.

THE PAWL MEANS 12

Figure 3:
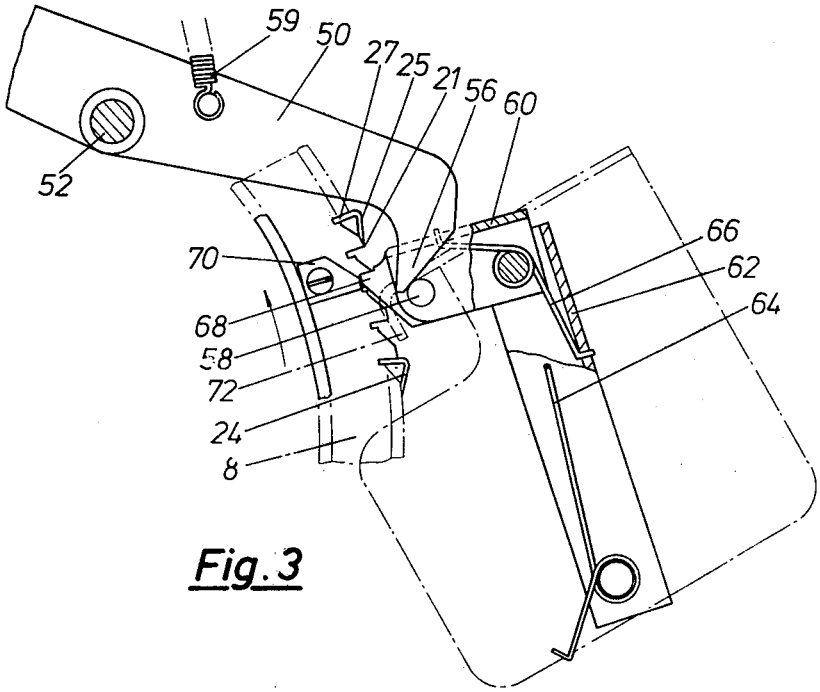
FIG. 3 is a side view, partially in section, showing particularly a trigger and arresting mechanism of the racking mechanism of FIG. 1.
Figure 4:
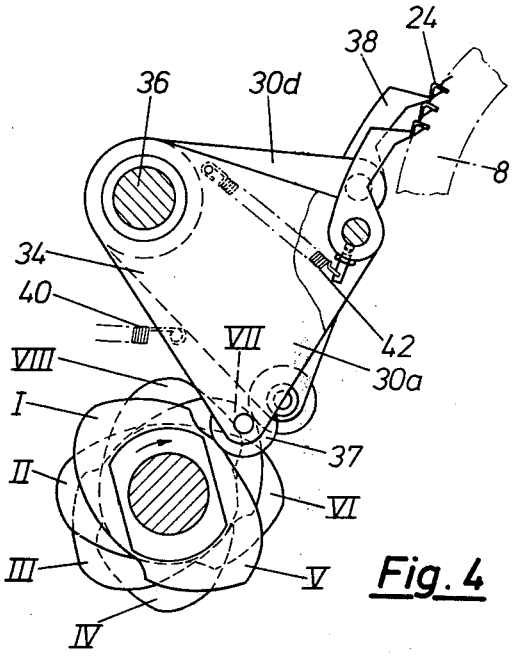
FIG. 4 is a side view showing particular pawls and pawl cams of the racking mechanism of FIG. 1.

With reference to FIGS. 1 to 3, the pawl means 12 comprise five pawl racking levers 30 spaced transversely across the rackwheel 8. The levers 30 are each associated with a cam 32 for reciprocating the levers in synchronisation with the rotation of the cylinders of the knitting machine. Each lever 30 includes a pair of triangular plates 34 pivotted at one corner on a fixed shaft 36 and carries a cam following roller 37 at another corner and a pawl 38 pivotably mounted at the remaining corner. Tension springs 40 pull the rollers 37 constantly onto the cam 32 and tension springs 42 urge the pawls 38 towards the rackwheel 8.

THE RACKING SEQUENCE TRIGGER AND ARRESTING MECHANISM 14

With reference to FIGS. 1 and 3, the mechanism 14 includes a lever 50 pivotably mounted on a shaft 52 and having at one end a follower 54 for engaging the studs on the timing chain 2 and at the other end a nose 56 for engaging a rod 58 for bluffing all the pawls 38. A tension spring 59 urges the follower 54 toward the chain 2.

The bluffing rod 58 is retained by a U-shaped bracket 60 and extends under the pivotable pawls 38 over the rackwheel 8. The shaped bracket 60 is in turn pivotably mounted on a member 62 mounted on the frame of the knitting machine. Spring 66 urges the bracket 60 forward from the member 62 and the spring 64 urges the member 62 itself downward with respect to the frame. The U-shaped bracket 60 has a downward extension 68 for engaging arresting elements (for ending a racking sequence) in the form of cam pieces 70 bolted onto the side of the rackwheel 8. An L-shaped abutment member 72 guides forward and downward movement of the bluffing rod 58 resulting from the springs 64 and 66 respectively.

In a rest position, the extension 68 will be on the tip of cam piece 70 as shown in FIG. 3. The rod 58 will raise all the pawls 38 and will prevent any of them from engaging the rackwheel 8. The studs 16 have short projecting portions to trigger the start of the racking sequence. The extension 68 is knocked from the rest position when the nose 56 is moved down as the follower 54 rises up and over a short trigger portion. The nose 56 then urges the rod 58 backward off the tip of the cam piece 70 and it is then sprung downwards, freeing the pawls 38. The follower 54 is returned to a low position, so that when a subsequent cam piece 70 is advanced, the rod 58 is free to rise. The pawls 38, remain capable of engaging the rackwheel 8, when the nose 56 is raised (after the follower 54 drops from the short projecting portion of a stud 16) because the rod 58 is biassed downward. The pawls 38 are only bluffed again by the extension 68 rising up a subsequent cam piece 70.

OPERATION, TIMING OF PAWL MOVEMENTS

For a double cylinder sock circular knitting machine, the timing would be as follows. The pawl 4 makes one forward movement for every cylinder revolution to rack the wheel 6. Two such movements will advance the timing chain 2 to the extent of one link. Each link of the chain 2 will then cover periods corresponding to 2 cylinder revolutions. A timing chain saving mechanism may be provided to periodically bluff the pawl 4 but this does not affect the operation other than interrupting the timing chain movement.

The studs 16 on the chain 4 are of two kinds; those having a short projecting portion at the front of a stud which passes under the follower 54 of the lever 50 at the first of two cylinder revolutions necessary to advance a particular link past the follower 54; and those having a short projecting portion halfway along the stud (shown in FIG. 1) which passes under the follower 54 only at a second cylinder revolution.

The pawls 38 and cams 32 are arranged to reciprocate in synchronisation with the cylinder revolutions as follows: Pawl 30*a* is advanced by lobe I on the cam 32*a* for the duration of the first quarter of a first cylinder revolution (at the time when a front half stud would be passing under the follower 54) and by lobe V for the first quarter of a second cylinder revolution (when a back half stud would be passing under the follower 54). Pawl 30*b* is advanced by a lobe II of the cam 32*b* only for the duration of the second quarter of the first cylinder revolution whereas another pawl 30*c* and cam 32*c* with a lobe VI advances the pawl during the second quarter of the second revolution. Pawls 30*d* and 30*e* with cams 32*d* and 32*e* having lobes III, VII and IV, VIII respectively, are advanced during the third quarter of the first revolution and second revolution and the fourth quarter of the first and second revolutions. The strokes of the pawls 30*a* to *e* are of the same length but timed differently to provide a pawl advance governed by the lobes I, II, III, IV, V, VI, VII and VIII for the duration of every quarter revolution during two cylinder revolutions, either for the duration of a single quarter revolution or for a combination of quarter revolutions. Thus a continuous racking movement may be provided for the duration of half a cylinder revolution or more.

OPERATION, RACKING SEQUENCES

An operative will fit out the timing chain with appropriately spaced studs 16 to define the instances at which racking of some kind should take place. A stud triggering at the first cylinder revolution of the two cylinder period covered by each timing chain link, will be used if the racking is to include movement initiated by lobes I, II, III or IV; a stud triggering at the second revolution of the two cylinder period if the racking sequence is to exclude movement derived from these lobes and is limited to movements originating from lobes V, VI, VII or VIII.

Cam pieces 70 will be fitted on the side of the rackwheel 8 to bluff the pawls 30*a* to *e* at the end of a racking sequence.

Bluffing elements 24 will be inserted into the recesses 22 so as to prevent all except one of the pawls 30*a* to *e* from engaging the presented tooth 20 of the rackwheel 8 after a stud 16 initiated a racking sequence and before a cam piece 70 terminates it. Where two or more tooth engagements are required to follow one another without any intervening bluffed racks, a bluffing element need not be inserted in the consecutively racked teeth, but the risk of mis-racking due to mechanical failure can be reduced by placing an appropriate element in every tooth.

By suitable combination of front and back half studs, cam pieces 70 and bluffing elements 24, the rackwheel 8 can be advanced continuously during two or more quarters of one cylinder revolution, or can be advanced intermittently.

ADVANTAGES

The racking mechanism of the invention comprises only a small number of standard components to satisfy a wide variety of requirements yet it is easily readable, in that an operative or tester can observe the position of the cut-away 26, see which pawl 38 will engage the rackwheel 8 and hence conclude whether racking will take place during the first, second, third or fourth quarter of a revolution. By noting the type of stud 16, the operative or tester can deduce whether the racking takes place during the first or second revolution of the two cylinder period covered by each link. The ease of reading is important to facilitate adjustment and testing of the knitting machine. The racking mechanism can thus be conveniently adapted to a variety of knitting requirements. The bluffing element is accommodated within the pitch of the teeth on the rackwheel itself, so that no additional space is required to the side of the rackwheel to bluff the pawls directly. The element construction is such that the shape of the existing rackwheel teeth is employed to locate the elements firmly.

The racking mechanism can be safely used for reciprocating circular knitting machines if a single lobe cam is used for operating a clutch for changing between rotary and reciprocatory knitting. If an operative inserts a wrong type of stud, pawls 30*b* and *c* will not be operated in the wrong cylinder revolution since they make only one movement during a two cylinder revolution period, each in a particular revolution or in particular direction of swing during reciprocatory knitting. It is then virtually impossible for an operative by inserting a wrong type stud to actuate the clutch in the wrong direction of swing during reciprocation for example.

By using direct bluffing elements, risk of mis-racking is reduced and also by using a separate pawl for each quarter revolution the reciprocating movement of the pawls can be accurately controlled. The mechanism is further simple and strong.

The trigger and arresting mechanism 14 bluffs all pawls at the end of a racking sequence. The triggering at the start and deactivation of the trigger until the racking sequence has been ended, ensure that the sequence may be made to extend over more than the activation period associated with a link without requiring the continuous presence of timing chain studs under the follower 54. A timing chain saving mechanism can hence be used even where a racking sequence is to last beyond one activation period.

The racking mechanism, previously described, differentiates between first and second cylinder revolutions by using half length studs to cause racking to be initiated on either revolution where necessary. Other constructions may be employed to differentiate between the first and second cylinder revolutions. For example the rackwheel 8 could have elements of different heights for selectively engaging the pawl. The stud could be provided with flats of a high and low level in all cases, causing the pawls to reciprocate high during a first cylinder revolution and low during a second cylinder revolution. The elements in the rackwheel 8 could be removable and adapted either to engage the pawl at a high or low level or reciprocation. The presence of an element opposite a pawl would indicate a rack during a particular quarter, and the adaption for high or low level engagement would indicate whether the racking was to take place during a first or second cylinder revolution.

We claim:

1. A racking mechanism for a circular knitting machine which includes a pair of first pawls and a plurality of second pawls, drive means for advancing the first and second pawls over the same distance in a continuous sequence, said drive means including first rotary cam means for advancing the first pawls alternately and second rotary cam means for advancing the second pawls at twice the frequency of the first pawls, a rack wheel evenly cut around its entire periphery and removable elements mounted in the rack wheel for conjoint rotation therewith for causing some of the pawls but not others to engage the rack wheel during a racking sequence.

2. Racking mechanism as claimed in claim 1 wherein the rack-wheel has evenly cut teeth around its entire periphery and said elements include at least one shielding portion for shielding a particular tooth from all pawls except one as the pawls advance in succession.

3. Racking mechanism as claimed in claim 1 wherein the rack-wheel has evenly cut teeth around its entire periphery and a groove between each pair of adjacent teeth and said elements have at least one shielding portion inclined to deflect the tip of the pawls radially outward and a second portion at an angle to the first extending past a tooth surface into the said groove.

4. Racking mechanism as claimed in claim 1 which further includes a means for bluffing all the pawls simultaneously, a racking sequence arresting member rotatable conjointly with the rack wheel for operating the bluffing means at the end of and at least one racking sequence, a timing chain, a racking sequence starting member mounted on the timing chain for operating the bluffing means at the beginning of a racking sequence to unbluff the pawls.

5. Racking mechanism as claimed in claim 4 wherein there is a plurality of racking sequence starting members mounted on the timing chain for operating the bluffing means at the beginning of a racking sequence, at least one of said members being of reduced length so as to enable a rack to be effected by the said further pawls after an initial series of idle strokes but not by one of the said pair of pawls which advanced during the initial series of idle strokes.

6. A racking mechanism as claimed in claim 1 wherein there is further provided a means for bluffing all the pawls including a first mounting member movable radially inward with respect to the rackwheel, a second mounting member mounted on the first movable member peripherally with respect to the rackwheel, a projection on the second mounting member, a pawl bluffing member for bluffing all the pawls on the second mounting member, resilient means biassing the first mounting member radially inward, and biassing the second mounting member peripherally in the direction of advancement of the rackwheel, an abutment and guide member permitting only radial and peripheral movement of the pawl buffing member against the bias imparted by the said resilient means, cam means on the rackwheel movable conjointly therewith for engaging the projection on the second mounting member of the bluffing means and moving the bluffing member and pawls radially outwards, a lever, a timing chain, a stud on the timing chain for pivotting the lever, a nose on the lever for pushing the second mounting member peripherally in a direction opposite to the direction of advancement of the rackwheel and the said projection thereon off the cam means to permit the resilient means to move the pawl bluffing member radially inward.

* * * * *